US005487196A

United States Patent [19]

Wilkinson et al.

[11] Patent Number: 5,487,196

[45] Date of Patent: Jan. 30, 1996

[54] AUTOMATED PRESSURE RELIEF MATTRESS SUPPORT SYSTEM

[75] Inventors: John W. Wilkinson, Bennington, Vt.; Richard W. Raburn, Simpsonville, S.C.

[73] Assignee: Span America Medical Systems, Inc., Greenville, S.C.

[21] Appl. No.: 179,604

[22] Filed: Jan. 10, 1994

[51] Int. Cl.[6] ..... A47C 27/10

[52] U.S. Cl. ..... 5/453; 5/455

[58] Field of Search ..... 5/453, 455, 914, 5/456

[56] References Cited

U.S. PATENT DOCUMENTS

| | | | |
|---|---|---|---|
| 4,279,044 | 7/1981 | Douglas | 5/453 |
| 4,617,690 | 10/1986 | Grebe | 5/453 |
| 4,694,520 | 9/1987 | Paul et al. | 5/453 |
| 4,797,962 | 1/1989 | Goode | 5/453 |
| 4,803,744 | 2/1989 | Peck et al. | 5/453 |
| 4,897,890 | 2/1990 | Walker | 5/453 |
| 4,949,412 | 8/1990 | Goode | 5/453 |
| 4,949,414 | 8/1990 | Thomas et al. | 5/453 |
| 4,989,283 | 2/1991 | Krouskoo | 5/453 |
| 4,995,124 | 2/1991 | Wridge et al. | 5/450 |
| 5,003,654 | 4/1991 | Vrzalik | 5/453 |
| 5,020,176 | 6/1991 | Dotson | 5/453 |
| 5,062,167 | 11/1991 | Thomas et al. | 5/61 |
| 5,070,560 | 12/1991 | Wilkinson | 5/455 |
| 5,073,999 | 12/1991 | Thomas et al. | 5/61 |
| 5,092,007 | 3/1992 | Hasty et al. | 5/453 |
| 5,103,519 | 4/1992 | Hasty et al. | 5/453 |

FOREIGN PATENT DOCUMENTS

| | | | |
|---|---|---|---|
| 0168213 | 4/1986 | European Pat. Off. | 5/453 |
| 3804959 | 8/1989 | Germany . | |
| 9307696 | 9/1993 | Germany . | |

*Primary Examiner*—Alexander Grosz
*Attorney, Agent, or Firm*—Luke J. Wilburn, Jr.

[57] ABSTRACT

Automated pressure relief mattress support system including method and apparatus for supporting a bed patient comprising an air mattress construction having a plurality of longitudinally extending flexible air compartments or tubes which are connected to a pressurized air source and uniformly pressurized to an optimum air pressure to minimize interface surface pressure between a patient and the mattress. The system is of simplified economical construction and can be operated both passively and actively to minimize patient/mattress interface pressures and to roll a patient to right and left side positions, typically to selected angles of up to about 30 degrees for preselected times, with roll position air pressure set points in the mattress air tubes for particular roll angles of the patient being automatically established, based on patient body weight.

18 Claims, 4 Drawing Sheets

*FIG. –5–*

AUTOMATED PRESSURE RELIEF MATTRESS SUPPORT SYSTEM

This invention relates to an automated pressure relief mattress support system, and, more particularly, a mattress system employing flexible, pressurized air compartments, or cylinders, for patient support, with automated control of the air pressure in the cylinders to maintain an optimum air pressure which minimizes pressure between a patient and the mattress surface, and to move the patient from center supine to right and left side positions for selected periods of time.

BACKGROUND OF THE INVENTION

It is known in the medical field to provide mattress constructions having flexible compartments for pressurized fluid to provide support for a bed patient to reduce pressure and sheer forces on the body of the patient by the mattress surface. It is also known to provide mattress constructions incorporating variously arranged flexible air compartments which may be inflated or deflated, as desired, to roll a patient from a center supine to a right or left side position on the bed for selected periods of time. Certain of such pressurized air support systems are known as "low air loss" systems which are continuously connected to a pressurized air source and have micropores in the flexible air compartments to continuously release pressurized air therefrom for various effects, such as heating, cooling, or drying of a patient's body.

U.S. Pat. Nos. which disclose and describe pressurized air mattress support systems are exemplified, as follows:

| | | |
|---|---|---|
| 5,103,519 | 5,020,176 | 4,949,412 |
| 5,092,007 | 5,003,654 | 4,803,744 |
| 5,073,999 | 4,995,124 | 4,797,962 |
| 5,070,560 | 4,989,283 | 4,694,520 |
| 5,062,167 | 4,949,414 | 4,617,690 |
| | | 4,279,044 |

Most of the listed patent constructions which utilize air compartment arrangements for the support and positioning of a bed patient are of relatively expensive and complex construction and design, and employ many variously configured air compartments under various portions of the patient's anatomy to move the patient, or to create a desired firmness or softness of support of the patient, as controlled by the patient or a patient attendant.

BRIEF OBJECTS OF THE INVENTION

It is an object of the present invention to provide an improved, relatively inexpensive air support mattress of simplified construction having associated control means for maintaining a desired uniform air pressure in all air compartments of the construction to reduce patient/mattress interface pressures, and for moving the patient from a center supine position to right and left side positions, as desired.

It is a further object to provide an air mattress support system which may be adjusted to maintain an optimum air pressure for minimum patient/mattress interface pressure, depending upon the particular weight of the patient, and wherein such optimum air pressure may be maintained during use by the patient without continuous supply of pressurized air to the mattress construction.

It is another object to provide a method of supporting a bed patient on a mattress to minimize patient/mattress interface pressures.

It is further object to provide a method for supporting a bed patient on a mattress to minimize patient/mattress interface pressures, and to move the bed patient thereon from supine to right or left side positions.

It is a more specific object to provide a method for moving a bed patient on a mattress construction from supine to right or left side positions wherein a specific predetermined angle of roll of the patient in right or left side positions can be accurately achieved automatically, based on the particular body weight of the patient on the mattress.

BRIEF DESCRIPTION OF THE DRAWINGS

The above as well as other objects of the invention will become more apparent and the invention will be better understood, from the following detailed description of preferred embodiments, when taken together with the accompanying drawings, in which.

SUMMARY OF THE INVENTION

The present invention comprises an automated pressure relief air support mattress construction having a plurality of longitudinally extending, flexible air compartments, or cylindrical tubes, which are interconnected and normally uniformly pressurized to an optimum air pressure to minimize interface surface pressure between a patient and the mattress. The system is of simplified, economical construction and can be operated both passively and actively. In passive operation, the cylindrical air tubes of the mattress are inflated to within a defined pressure range which minimizes pressure at the patient/mattress interface and aids in prevention and treatment of pressure sores on the patient.

The system also may be operated actively by connection to a pressurized air supply, control, and monitoring system for roll, or rotation, of a patient to right and left side positions, typically to selected angles of up to about 30 degrees, for selected dwell times. Rotation of the patient is accomplished by manual or automatic control of the air pressures in selected pairs of air tubes to achieve predetermined pressure values.

In one specific embodiment, the mattress construction includes an outer cover of vapor-permeable material. Inside the cover are foam support layers of selected densities to contour to the body of the patient and reduce interface pressure. Flexible cylindrical air tubes extending in parallel longitudinal relation throughout the length of the mattress are maintained in supporting jackets to maintain proper position. The air tubes may be framed on each end and on both sides with polyurethane foe bolsters. Lateral slats may be positioned in the mattress to reduce "hamhocking" of the patient and distribute weight forces of the patient's body.

The control unit for the mattress system includes a source of pressurized air, such as an air compressor, or blower, a valve and manifold arrangement connecting the blower to the air tubes, air pressure sensors associated with the tubes, and control means including a microprocessor and a manual control panel for operating the valve and manifold arrangement in an active mode, automatically or manually, to provide air at a preselected pressure in the air tubes.

DETAILED DESCRIPTION OF PREFERRED EMBODIMENTS

Figure 1:
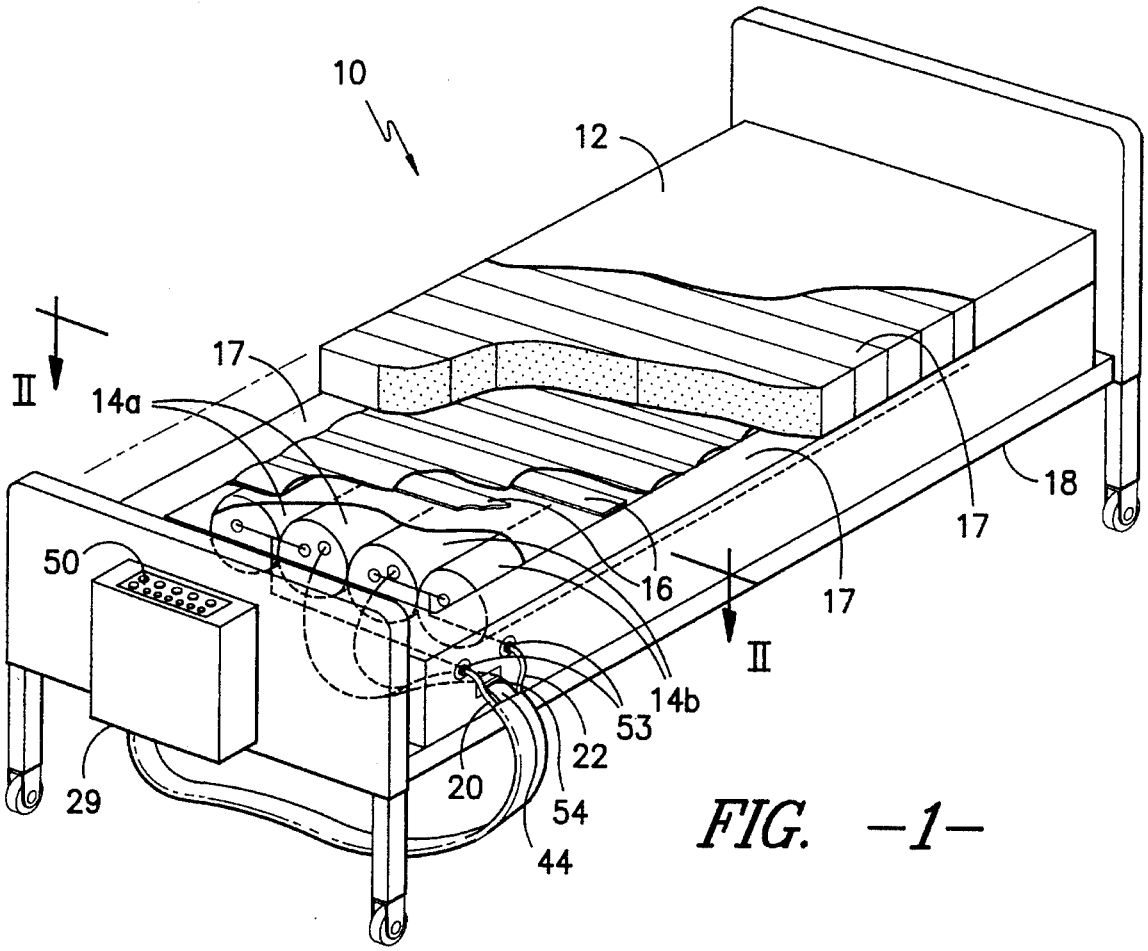
FIG. 1 is a perspective view of a standard hospital bed frame supporting an automated pressure relief mattress support system of the present invention, with portions of the mattress construction of the system broken away and removed to better show interior components of the mattress construction.

As seen in the drawings, and more particularly FIG. 1, the pressurized air mattress construction 10 of the present invention is of a generally rectangular shape having an outer cover 12 of suitable material, such as a vapor-permeable woven textile fabric, which encloses and contains a plurality of flexible, essentially air-impervious compartments, or cylindrical tubes 14*a*, 14*b*, extending longitudinally from head to foot of the mattress in side-by-side relation. Extending transversely across the mattress in parallel side-by-side relation may be a plurality of slats 16 of relatively resilient material which extend across the four air tubes 14*a*, 14*b* to permit more even body weight distribution across the mattress, thereby reducing pressure on the tissue and skin of the patient. Overlying and surrounding the air tubes 14*a*, 14*b* and slats 16 in the mattress cover 12 are one or more foam layers of material 17. Such a mattress construction is disclosed in U.S. Pat. No. 5,070,560, the disclosure which is incorporated herein by reference.

The mattress construction thus described may be placed on a conventional hospital bed frame 18, head and foot portions of which may be articulated to raise and lower upper and lower ends of the mattress. Due to the arrangement of the air tubes 14*a*, 14*b* in longitudinal, side-by-side position in the mattress construction, the mattress may be angularly positioned without changing the air pressure in the compartments as a result of articulation.

Figure 2:
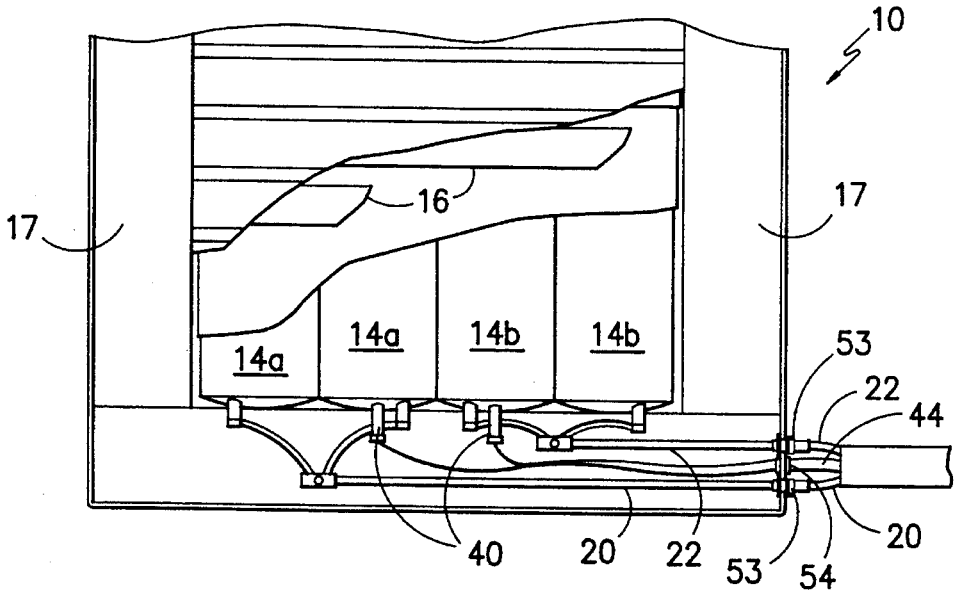
FIG. 2 is an enlarged sectional plan view of the bottom portion of the mattress construction of FIG. 1 taken generally looking in the direction of arrows II—II, and with portions broken away and removed to show the internal arrangement and connection of the flexible air compartments of the mattress to a source of pressurized air.
Figure 4:
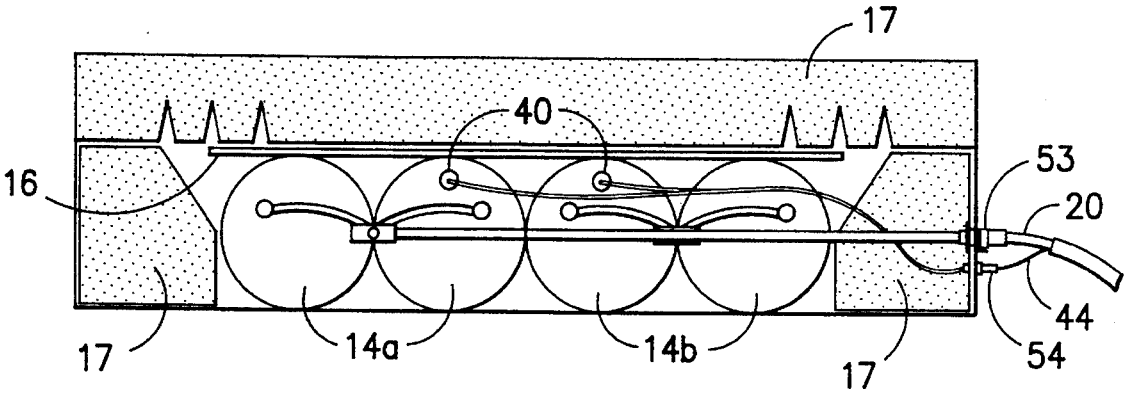
FIG. 4 is a sectional end elevation view of the bottom end of the mattress construction as seen in FIG. 2.
Figure 5:
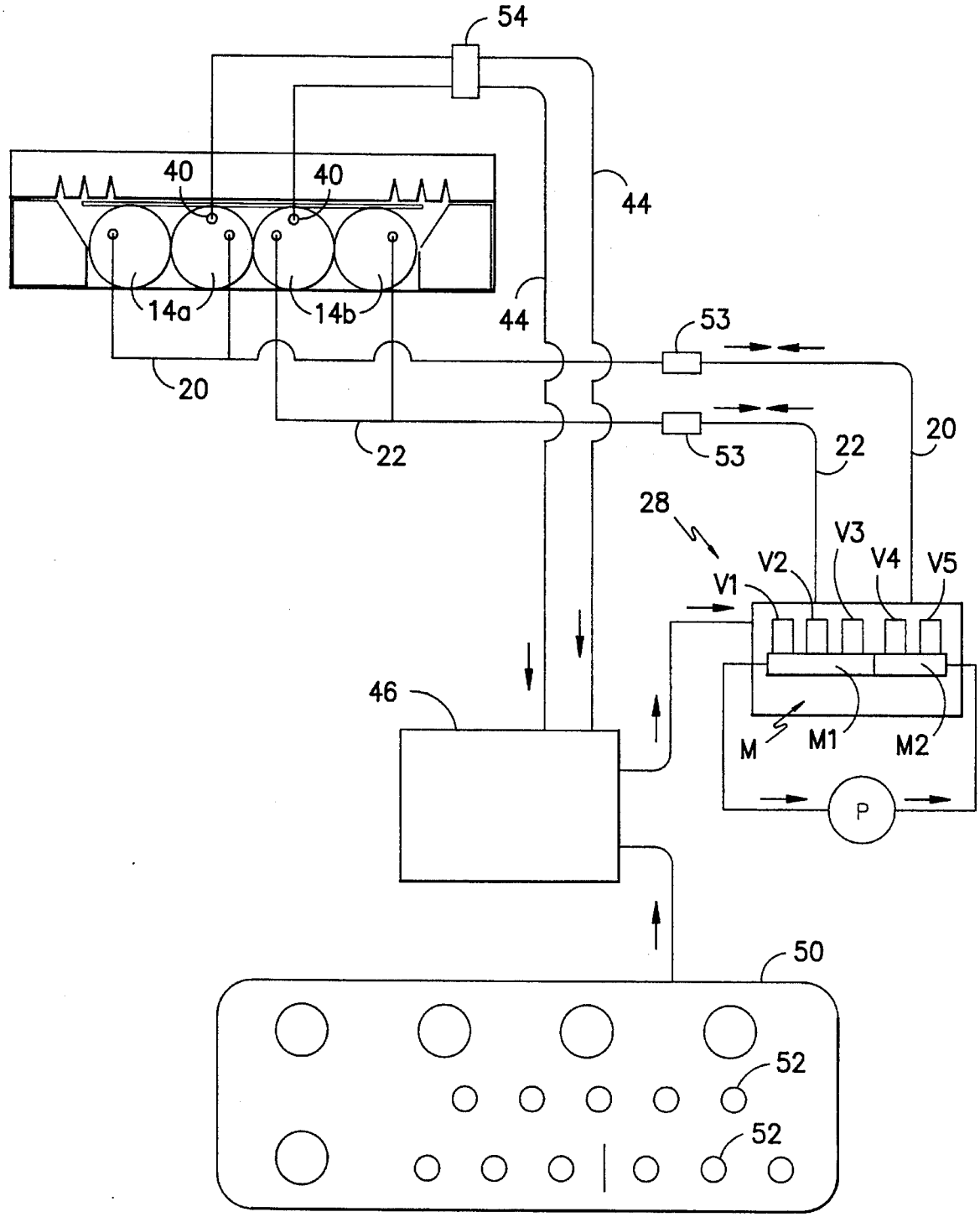
FIG. 5 is a diagrammatic representation of the major component parts of the mattress support system of the present invention, showing inner-connection of the air supply and control units to the air compartments of the mattress construction.
Figure 6:
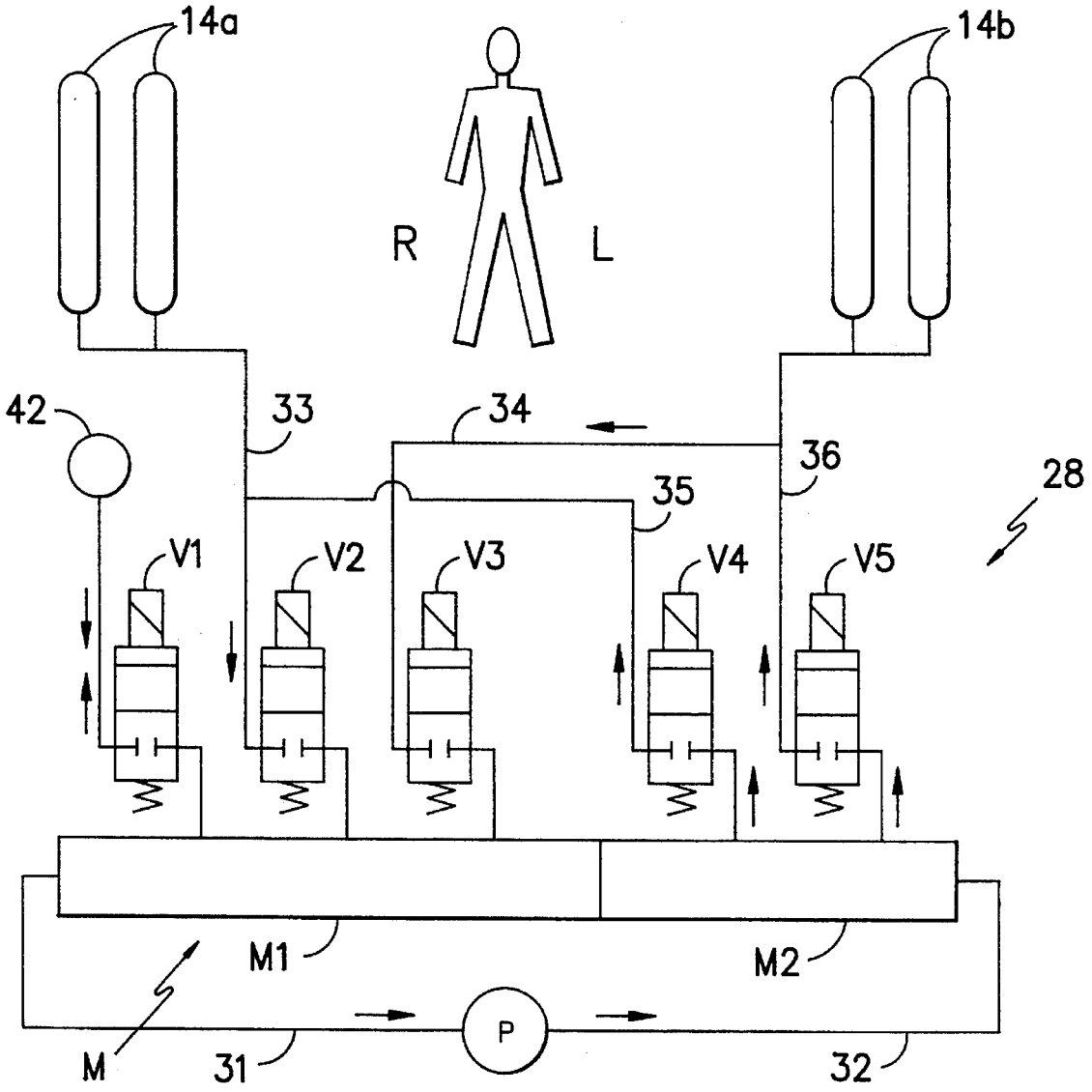
FIG. 6 is a pneumatic representation diagram showing the operative interconnection of the solenoid control valves with pressurized air supply and air compartments of the mattress support system.

As shown in FIGS. 2, 4, and, 6, the longitudinal air tubes comprise communicating left side and right side pairs, 14*a* and 14*b*, respectively. Tube pair 14*a* and tube pair 14*b* communicate by separate supply conduits 20, 22 to a pressurized air source. As seen in FIGS. 5 and 6, pressurized air, supplied from a suitable air source, such as an air compressor, or pump P, is connected through a valve and manifold arrangement 28 to provide air at a desired pressure in each of the air tube pairs 14*a* and 14*b*, as will be explained. The valves V1–V5 are solenoid-operated, either manually or in response to microprocessor program information to maintain a selected uniform optimum pressure in all air tubes to minimize patient/mattress interface pressures, or to move the patient between center supine and right and left side positions on the mattress, as will be described. As shown in FIG. 1, a control box 29, located at a convenient position on the foot of the bed frame 18, houses a manual control panel 50, microprocessor 46 (FIG. 5), and valve and manifold arrangement 28 (FIGS. 5 and 6).

The air tubes 14*a*, 14*b* of the mattress construction may be formed of a suitable flexible, essentially air-impervious material, such as a woven polymeric outer fabric sealed with a polymeric film, such as polyurethane. The tube construction ensures that air can be maintained at a desired pressure within the air tubes for an indefinite period of time, without the need for continuous supply of additional pressurized air to maintain such pressure, as in the case of the "low air loss" systems of the prior art.

Through evaluation in test procedures, it has been found that the four air tubes 14*a*, 14*b* of mattress construction 10 may be inflated to an air pressure to minimize patient/mattress interface pressure and reduce decubitus or pressure sores. Patient/mattress interface pressure may be conveniently measured by use of an interface pressure tester, such as an Ergo Check pressure measuring system manufactured by ABW, Gmbh of Germany. An optimum air pressure for the particular mattress construction described herein has been found, through interface pressure measurements, to reside within a narrow range for most, if not all, patient weights and sizes, and is established in the air tubes when the weight of a patient is on the mattress. In the mattress construction described, this optimum range has been found to be between about 0.250 and 0.350 psi.

To prepare the mattress for maintenance of a patient to minimize mattress interface pressure on the body, the patient is placed in supine position on the bed at a given geographic elevational location and the air tubes pressurized or depressurized to the predetermined desired optimum value. Thereafter, the pressurized air source and its related equipment may be disconnected from the mattress and the mattress maintained at the optimum air pressure for the particular patient for an indefinite period of time.

As best seen in FIGS. 5 and 6, the control valve and manifold arrangement 28 includes five direct-operated type, two-port solenoid valves V1–V5 with manifold M, such as a Series VVX21/22/23, manufactured by SMC Pneumatics, Inc. of Boston, Mass. As shown schematically, valves V1, V2 and V3 are normally closed valves and valves V4 and V5 are normally open valves, such that solenoid valves V1, V2, and V3 must be energized to open, while valves V4 and V5 must be energized to close. The manifold M has two sides, or compartments, one side or compartment M1 which communicates directly with valves V1, V2 and V3 and the inlet side of air pump P, and the other side or compartment M2 which communicates directly with valves V4 and V5 and the outlet side of air pump P. Under "no power" conditions, this arrangement of the valves and manifold ensures that the 14*a* and 14*b* air tube pairs of the mattress construction are cross-connected and pressure is equalized, as will be explained.

As schematically illustrated in FIGS. 5 and 6, the solenoid-operated valve and manifold arrangement 28 is electrically connected to and operated from microprocessor 46 (which may be an INTEL microprocessor #8051) and control panel 50. Valves V1–V5 and manifold compartments M1, M2 are interconnected by air flow lines 31, 32 to the inlet and outlet sides of air pump P and to the air tube pairs 14*a* and 14*b* by conduits 33–36. To inflate all the air tubes to a desired air pressure, an air pressure sensor 40, such as a Sylvania Pressure Transducer No. MPX106P/9310 (FIG. 5), is operatively associated with each pair 14*a* and 14*b* of the air tubes to measure the internal air pressure in each pair.

On the inlet side of pump P, in opened positions, valve V1 communicates outside room air, as from air inlet 42, with manifold compartment M1, valve V2 communicates air tube pair 14*a* and valve V4 with the manifold compartment M1, and valve V3 communicates the 14*b* pair of air tubes and Valve V5 with the manifold compartment M1.

On the outlet or pressure side of plump P, in opened positions, valve V4 communicates manifold compartment M2 with the air tube pair 14*a* and valve V2, while valve V5 communicates the manifold compartment M2 with the 14*b* pair of air tubes and valve V3.

The pressure sensor 40 located on the inside tube of each pair of tubes 14*a*, 14*b* is suitably operatively connected by electric leads 44 to the microprocessor unit 46 which contains programmed air pressure set point information to permit manual or automatic operation of the valves V1–V5 to introduce or remove air from the tube pairs to obtain a desired or preselected air pressure in the air tubes.

The operation of the air pressure regulation and control features of the present invention may be described, as follows. FIG. 6 schematically illustrates the air tubes 14*a*, 14*b* and manifold and valve control arrangement 28, looking from the perspective of the foot of the bed, patient, and the air mattress. To inflate the air tubes of the mattress to a desired internal air pressure as set in the microprocessor program information to minimize patient/mattress interface pressures, valve V1 is opened and pump P energized to supply air to the 14*a* and 14*b* pairs of air tubes via opened valves V4 and V5. When the pressure in the four air tubes reaches the established uniform set point, e.g. 0.25 psi, valves V4 and V5 are closed to establish and maintain the desired set point uniform pressure in all four of the air tubes. The pump P is de-energized and valve V1 closed.

To deflate the air tubes of the mattress to a desired internal air pressure set point to minimize patient/mattress interface pressures, valves V1, V2 and V3 are opened and valves V4 and V5 are closed. The pump reins de-energized while air is bled from the air tube pairs via valves V2 and V3, via the manifold compartment M1, and valve V1 to ambient air. When the reduced set point is reached, valves V1, V2 and V3 are closed and valves V4 and V5 are closed.

Figure 3:
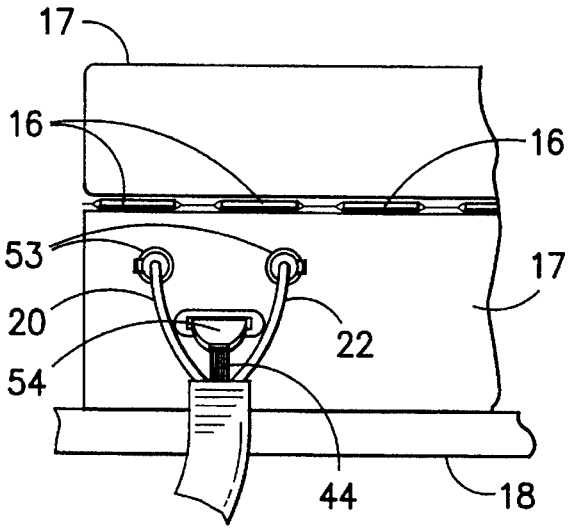
FIG. 3 is an enlarged side elevation view of the left lower section of the mattress construction of FIG. 1 showing the quick disconnect coupling arrangement of the pressurized air supply conduit and pressure sensing means communicating the air compartments with the pressurized air supply and control unit of the system.

The mattress construction of the present invention may thereafter be disconnected from the pressurized air source and control means through quick-release coupling connectors 53, 54 (FIG. 3) and the mattress utilized with a uniform optimum air pressure in the air tubes based on the weight of the patient, at the particular geographic elevation of use.

The air mattress construction of the present invention may also be used in an active mode to provide for orientation or adjustment of a patient from left to right side positions on the mattress by means of the control features and valving arrangement of the present invention. Air pressure set points for air tube pairs 14*a* and 14*b* may be established for various degrees of left or right side rotation of the patient from center supine position, typically from about 5 degrees up to about 30 degrees from the horizontal plane.

Referring to FIG. 6, to roll the patient (1) from a right side to a center or a left side position, or (2) from a center to a left side position, valves V3 and V4 are opened, the pump started, and valve V5 is closed to transfer air from tube pair 14*b* to tube pair 14*a*. When a desired air pressure set point is achieved in the 14*b* tube pair, valve V3 is closed. If additional air is needed to achieve the desired set point in the 14*a* pair tubes, valve V1 is opened and the pump operated to supply room or outside air to the 14*a* pair tubes. When the set point is achieved in the 14*a* pair tubes, valve V1 is closed and V4 is closed. The plump is then stopped.

To roll the patient (1) from a left side to a center or to a right side position, or (2) from a center position to a right side position, valves V2 and V5 are opened, the pump is started, and valve V4 is closed to transfer air from the 14*a* pair tubes to the 14*b* pair tubes. When the desired set point is achieved in the 14*a* pair, valve V2 is closed. If additional air is needed to achieve the desired set point in the 14*b* pair, valve V1 is opened and the pump operated to supply air until the set point is reached on the 14*b* pair. At such time valve V1 is closed and valve V5 is closed. The pump is stopped.

To inflate the mattress construction to a firm or hard condition for patient ingress and egress and for CPR administration, valve V1 is opened, the pump started, valves V4 and V5 are opened and valves 2 and 3 are closed to achieve preselected set points at 14*a* and 14*b* tubes. Valves V1, V4 and V5 are then closed and the pump stopped.

In the event of power failure, with the valving arrangement shown, wherein valves V1, V2 and V3 are normally closed and valves V4 and V5 are normally open, power failure automatically cross-connects the 14*a* and 14*b* tube pairs to equalize the pressure in the mattress construction. In situations of loss of power to the control means and solenoid control valves, the normally opened and normally closed valves, V1–V5 are connected to the air tubes 14*a*, 14*b* to ensure their cross-connection and equalization of pressure in all of the air tubes. As seen in FIG. 6 the communicating air conduit lines connecting the valves to the air tubes, normally closed valves V1, V2, and V3 and normally opened valves V4 and V5 (under no-power conditions), communicate tubes 14*a* directly with tubes 14*b* by way of air lines 33, 35, valve V4, manifold compartment M2, valve V5, and air line 36.

The operative relationship of the component parts of the automated pressure relief mattress support system are shown diagrammatically in FIG. 5. As seen, air tube pairs 14*a* and 14*b* of the mattress construction are connected in pairs by conduits 20, 22 respectively to the valve and manifold assembly 28, which is in turn operatively connected to the pump P by the solenoid-operated valves V1, V2, and V3 connected to the inlet side of the pump and solenoid valves V4 and V5 connected to the outlet side of the pump. Pressure sensors 40 located in inside tubes of the two pairs of tubes 14a and 14b are connected by suitable electrical leads to the microprocessor unit 46 containing programmable means for automated operation of the valve and manifold assembly and pump by way of electrical lines 48. Internal air pressure set points in the air tube pairs 14*a*, 14*b* are established in the control program, in known manner, to operate the valves in establishing an optimum uniform air pressure in all the air tubes of the mattress construction. Also operatively connected to the microprocessor 46 for operation thereof in a manual mode is manual control means shown, as control panel 50, on control box 29 of the bed 18. Manually operated electrically connected buttons 52 are provided for use by an operator to provide orientation of the patient from a center supine position to right and left side positions and return, with dwell times of selected periods and roll angles of selected angular position.

An important feature of the present invention provides that the mattress construction and air control means may be used to move a bed patient from supine to right or left side angular positions which are accurately automatically established based on the body weight of a patient utilizing the bed. It has been found that a particular roll angle of a patient's body on the mattress construction of the present invention is directly affected by the patient's body weight. For example, to rotate a person of a given body weight to a given angular position, e.g., 30 degrees from the horizontal, requires a different internal air tube pressure from that of a person of a different bodyweight, due to the different air pressure required to maintain the patient in the desired angular position.

Thus, it can be understood that it is necessary to establish an air pressure differential, or variation, transversely cross the air mattress construction by selectively increasing and/or decreasing the internal air pressures in the right and left side pairs of air tubes 14*a*, 14*b*. Typically, the air pressure in the lower pressure side pair of tubes may be set at a preselected reduced pressure for the particular degree of patient roll, such that only the air pressure in the higher pressure side pair of air tubes need be varied, based on body weight, in accordance with program information. This reduces the amount of program information which must be employed to create the air pressure differential across the air mattress to produce the roll angle desired. Alternatively, the air pressure in the higher pressure side pair of air tubes may be set at a preselected amount and the lower pressure side air tube pair pressure varied, based on patient body weight. Additional data can be calculated, in the manner hereinafter disclosed, to simultaneously adjust both air tube pair air pressures, based on body weight, if desired.

The automated control mattress construction of the present invention may be employed to measure body weight of a patient placed on the bed and to utilize such information through program control of the microprocessor to automatically adjust end-point internal air tube pressure settings necessary to locate a particular weight patient at a desired angular position, e.g., 5 degrees, 20 degrees, 30 degrees, relative to a horizontal plane.

The following procedure was employed to establish the microprocessor program data for automatically setting the air pressure end points based on patient body weight. Patient subjects, two male and two female, were used to obtain weight/air pressure information. Subject weights ranged from 120 to 223.5 lbs. An internal air pressure was set for an unoccupied inflated mattress construction having four 8¼ inch diameter air tubes. A subject patient when lay down upon the mattress and the internal air tube pressure for the loaded mattress was recorded. Four sets of measurements for each subject were recorded and differential pressure increases were calculated by subtracting the average increase or surge air pressure from the average unoccupied air mattress pressure.

More specifically, all tubes of the mattress were inflated to 0.250 psi from the air supply lines and the air supply lines disconnected from the mattress. Each patient subject was placed upon the mattress and the resulting pressure surge data was averaged over a minimum of 30 data scans. Minimized variance and data from the left and right side tubes pairs were averaged to account for any variation in positioning of the patient upon the mattress. Pressure data was collected in Microsoft Works on a personal computer by way of an RS232 interface on the mattress control box 29. For 16 tests performed, the following data was obtained:

| Patient Body Weight | delta P (Pressure surge in psi) |
|---|---|
| 120 | .161 |
| 120 | .159 |
| 120 | .155 |
| 120 | .163 |
| 146 | .181 |
| 146 | .177 |
| 146 | .195 |
| 146 | .186 |
| 188 | .226 |
| 188 | .226 |
| 188 | .228 |
| 188 | .225 |
| 223.5 | .269 |
| 223.5 | .277 |
| 223.5 | .285 |
| 223.5 | .285 |

From the data collected, conventional linear regression analysis was employed utilizing Lotus 1-2-3 instruction information found in "Predicting Trends with Regression Analysis", *Users Guide, Lotus* 1-2-3 *for DOS-Release* 2.4, Lotus Development Corporation, Cambridge, Mass.; 1991. Such conventional linear regression analysis procedures are also described in *CRC Standard Mathematical Tables,* pgs. 576–577, The Chemical Rubber Company, Cleveland, Ohio, 1973. Linear regression analysis established a straight-line relationship between weight and air pressure surge, or increase. Weight was identified as an independent variable X with pressure surge as a dependent variable Y to establish the formula Y=0.001137X+0.019757 where Y equals the pressure surge or increase and X equals the patient body weight.

A second regression analysis was performed using pressure surge as the independent variable X and body weight as the dependent variable Y. It established the following formula: Y=859.0853 (X)−13.0773.

Utilizing this foregoing developed formula, a patient of unknown weight was placed upon the mattress to obtain a pressure surge of 0.210 psi. A body weight was obtained by the derived formula:

Y=859.0853 (0.210)−13.0773

Y=167.3# patient body weight.

As a further step in establishing the necessary computer program data for automatically setting air pressure end points for patient roll based on patient body weight, two patients of known body-weight were placed on the mattress and the air tube pairs 14*a*, 14*b* respectively deflated and inflated to achieve a 30 degree angle of roll, as measured from the horizontal plane. Utilizing- a set, preselected pressure of 0.05 psi in the lower pressure side pair of air tubes, a measured inflation setpoint of 1.12 psi was required in the higher pressure side pair of air tubes to achieve a 30 degree roll angle for a 120 lbs. patient. Similarly, a 223.5 lbs. patient required a high side pair air tube inflation set point of 1.18 psi with a low side preset air pressure of 0.05 psi to achieve the 30 degree roll angle. Utilizing this accumulated data, the internal air pressure on the higher lifting side pair of air tubes (with a low side pressure preset at 0.05 psi) was calculated for a 167.3 lbs. patient, by the following ratio and proportions:

$$\frac{223.5-120}{167.3-120}=\frac{1.18-1.12}{\text{Increase in Internal Pressure for 30 Deg. Roll for 167.3\#}}$$

$$\frac{103.5}{47.3}=\frac{.06}{\text{Increase Pressure}}$$

-continued

.027 = Increase Pressure 1.147 PSI = Pressure setpoint for 167.3# patient for 30 degree, for 0.05 psi low side This accumulated data may be employed in conventional known manner to program the microprocessor to establish automatic preset air pressure end points for exact patient body roll angles based on patient body weight.

Thus, it can be seen that a patient having a body weight of 167.3 lbs. may be rolled to a 30 degree angle of roll on right or left side by increasing the pressure set point in the two tubes on the side of the patient's body which is being raised, and by correspondingly decreasing air pressure in the two tubes on the low side of the patient. For a 30 degree angle of patient roll, it has been pdetermined through experimentation that the two low side air tubes of the mattress are reduced in pressure from 0.250 (normal supine pressure) to 0.05 psi. This low side air pressure has been found satisfactory for 30 degree angles of roll for patients of all body weights within the range tested. Thus it is only necessary to variably adjust the two air tubes lifting the patient's body.

The control means of the present invention may also be employed to sense a sudden pre-established large change in air pressure in the compartments of sufficiently large value indicative of the presence or absence of a bed patient on the mattress construction and to provide a signal, such as visual or aural indicator located at a suitable location, such as on control box 29 to alert an attendant of the absence or presence of a patient on the mattress construction.

That which is claimed is:

1. A method of supporting a bed patient on a mattress comprising the steps of:

(a) providing a mattress having a plurality of elongated flexible substantially air-impervious compartments extending longitudinally of the mattress in side-by-side relation, said compartments including right and left side elongated tube means;

(b) determining an air pressure in said compartments of the mattress which minimizes patient-to-mattress interface pressure;

(c) supporting a bed patient on the mattress in a given geographic location of use; and (d) uniformly pressurizing the compartments with air to said pressure which minimizes patient-to-mattress interface pressure.

2. A method as defined in claim 1 including the steps of sensing the air pressure in said compartments when the bed patient is on the mattress at a given geographic location of use; and, maintaining the pressure in said compartments in response to said sensing to maintain said uniform pressure therein.

3. A method as defined in claim 1 including the step of communicating said right and left elongated tube means to transfer air between said right and left side tube means and to introduce and remove air selectively therefrom.

4. A method as defined in claim 1 including the step of varying the pressure in selected of said right and left side tube means to move a patient thereon selectively to right and left side positions on the mattress.

5. A method as defined in claim 4 including the step of maintaining a patient in said right and left side positions on the mattress for pre-selected periods of time and for returning the patient to a horizontal supine position on the mattress.

6. A method as defined in claim 5 including the step of automatically maintaining and returning the patient to said right and left side positions and said horizontal supine position in response to program information.

7. A method as defined in claim 1 including the step of automatically equalizing pressure in all of said compartments in the absence of an external source of power to pressurize said compartments to ensure equal pressurization of the tube means.

8. A method as defined in claim 1 wherein the minimum patient-to-mattress interface pressure is determined by placing a patient on the air mattress construction, varying the air pressure in the compartments of the construction, measuring the interface pressures between patient and mattress during variation of the air pressure in the compartments of the mattress, and noting the air pressure in the compartments which produces said minimum patient-to-mattress interface pressure.

9. A method of supporting a bed patient on a mattress comprising the steps of:

(a) providing a mattress having a plurality of elongated, flexible, air-tight compartments extending longitudinally of the mattress in side-by-side relation for support of a bed patient thereon, with left and right side adjacent pairs of said compartments directly intercommunicating;

(b) determining an air pressure in said compartments of the mattress which minimizes patient-to-mattress interface pressure;

(c) supporting the bed patient on the mattress in a given geographic location of use; and (d) pressurizing the compartments with air to said pressure which minimizes patient-to-mattress interface pressure.

10. A method as defined in claim 9 including the step of articulating sections of the mattress containing the bed patient thereon while maintaining said minimum interface pressure without use of additional pressurized air.

11. A method as defined in claim 9 including the further steps of selectively incrementally inflating and deflating selected of said right and left side pairs of longitudinal compartments of the mattress to move the bed patient thereon from supine to right or left side positions.

12. A method as defined in claim 9 including the further step of increasing the air pressure in all said air compartments a sufficient amount to provide substantial rigid support of a bed patient on the mattress construction to facilitate patient treatment and ingress and egress of the patient with the mattress.

13. A method as defined in claim 9 including the steps of sensing a predetermined change in air pressure in said compartments indicative of the presence or absence of a bed patient on the mattress construction and providing a signal in response to such change.

14. A method of positioning the body of a bed patient in predetermined right or left side angular positions relative to the horizontal plane of a mattress construction having right and left side longitudinally extended air tube means selectively inflatable to a desired internal air pressure for support and movement of the bed patient on the mattress construction, comprising the steps of:

(a) establishing a pre-determined uniform air pressure in all of said air tube memos with the mattress construction unoccupied by a bed patient;

(b) placing a plurality of bed patients of varying body weight sequentially on the mattress construction while measuring the changes in air pressure in said air tube means resulting from the weight of each patient placed thereon;

14 (c) correlating the various changes in air pressures in said air tube means due to patient weight changes to establish a linear relationship between air pressure variations and patient body weights;

(d) placing a plurality of bed patients of varying body weight sequentially on the mattress construction and increasing or decreasing the air pressure in left or right side air tube means to move the patient's body on the air mattress to a predetermined measured angular position relative to the horizontal plane while recording the increase in air pressure required to move the patient to said pre-determined angle;

(e) correlating the recorded pressure increases required to move the plurality of bed patients to the pre-selected angle to determine a linear relationship between the recorded values; and (f) utilizing the information obtained from the air pressure/patient body weight relationship and the angular position/patient body weight relationship to automatically determine a pressure cut-off limit for air pressure in the right or left side air tubes during patient body movement to a selected angular position based on body weight of the patient.

15. A method as defined in claim 14 wherein the changes in air pressures in the air tube means due to patient weight changes are correlated by linear regression analysis.

16. An air support mattress for a bed patient, adapted to move a patient from horizontal supine to right and left side positions, comprising a plurality of elongated, flexible, substantially air impervious compartments extending longitudinally of the mattress in side-by-side relation, said compartments including right and left side elongated tube means, valve means communicating with said tube means for introducing air into and removing air from said tubes, and control means for sensing and measuring air pressure variations in said right and left side tube means between the absence and the presence of a patient's body weight on the bed, and for rotating the patient to pre-selected right and left side angular positions relative to the horizontal plane based on said air pressure variations.

17. Apparatus as defined in claim 16 wherein said control means includes means for determining an increase in air pressure in said tube means when a patient's body weight is placed on the bed, and program means for utilizing said increase in air pressure information in said tube means to vary air pressure between right and left side tube means of the mattress construction to move the patient to said predetermined angular right or left side positions relative to the horizontal plane.

18. Apparatus as defined in claim 16 wherein said valve means includes means for automatically equalizing pressure in all of said compartments in the absence of an external source of power to pressurize said compartments.

* * * * *

UNITED STATES PATENT AND TRADEMARK OFFICE

CERTIFICATE OF CORRECTION

PATENT NO. : 5,487,196

DATED : January 30, 1996

INVENTOR(S) : John W. Wilkinson, Richard W. Raburn

It is certified that error appears in the above-identified patent and that said Letters Patent is hereby corrected as shown below:

On the title page, References Cited, item [56], the name of the inventor of U.S. Patent No. 4,989,283 should be changed from "Krouskoo" to --Krouskop--.

In column 2, line 4, add --a-- before "further".

In column 3, line 17, change "foe" to --foam--.

In column 3, line 18, change "hamhocking" to --hammocking--.

In column 5, line 13, change "Valve" to --valve--.

In column 5, line 44, change "reins" to --remains--.

In column 5, line 14, change "plump" to --pump--.

In column 6, line 8, change "plump" to --pump--.

Column 7, line 48, change "when" to --then--.

UNITED STATES PATENT AND TRADEMARK OFFICE

CERTIFICATE OF CORRECTION

PATENT NO. : 5,487,196

DATED : January 30, 1996

INVENTOR(S) : John W. Wilkinson, Richard W. Raburn

It is certified that error appears in the above-identified patent and that said Letters Patent is hereby corrected as shown below:

In column 8, line 46, delete "-" between the words "body" and "weight".

In column 8, line 49, delete "-" that appears after "Utilizing".

In column 9, line 19, change "pdetermined" to --predetermined--.

In column 10, line 66, change "memos" to --means--.

In column 11, line 6, delete "14" before "(c)".

Column 12, lines 23 and 24, change "predetermined" to --pre-selected--.

Signed and Sealed this

Ninth Day of July, 1996

*Attest:*

Bruce Lehman

BRUCE LEHMAN

*Attesting Officer*

*Commissioner of Patents and Trademarks*